US005823744A

United States Patent [19]

Rockwood

[11] Patent Number: 5,823,744

[45] Date of Patent: Oct. 20, 1998

[54] CENTRIFUGAL PUMP WITH MEANS FOR PREVENTING IMPELLER FROM UNSCREWING OFF OF SHAFT

[75] Inventor: Robert E. Rockwood, Windham, N.H.

[73] Assignee: Environamics Corporation, Hudson, N.H.

[21] Appl. No.: 648,278

[22] Filed: May 15, 1996

[51] Int. Cl.[6] ..... F04D 29/34

[52] U.S. Cl. ..... 416/204 R; 403/299

[58] Field of Search ..... 416/204 R; 403/299, 403/260, 258

[56] References Cited

U.S. PATENT DOCUMENTS

| | | | |
|---|---|---|---|
| 3,359,912 | 12/1967 | Gates | 416/204 |
| 4,863,353 | 9/1989 | Manninen | 416/204 R |
| 4,993,864 | 2/1991 | Gjertsen et al. | 403/299 |
| 5,087,173 | 2/1992 | Uliana et al. | 416/204 R |
| 5,172,607 | 12/1992 | Wu | 403/299 |
| 5,340,273 | 8/1994 | Rockwood . | |
| 5,484,267 | 1/1996 | Rockwood . | |
| 5,494,299 | 2/1996 | Rockwood . | |
| 5,513,964 | 5/1996 | Rockwood . | |

*Primary Examiner*—John T. Kwon
*Attorney, Agent, or Firm*—Myers Liniak & Berenato

[57] ABSTRACT

A centrifugal pump having a system for preventing unscrewing of the impeller off of the pump shaft is disclosed. The impeller is screwed onto the pump shaft via threads having a first thread pitch, and a lock bolt is inserted through the impeller and screwed into the pump shaft via threads having a second thread pitch. The second thread pitch is greater than the first pitch. Accordingly, if the pump motor is operated in the wrong direction, the impeller is prevented from unscrewing because the impeller attempts to move faster axially than the lock bolt which is holding the impeller on the pump shaft.

15 Claims, 2 Drawing Sheets

CENTRIFUGAL PUMP WITH MEANS FOR PREVENTING IMPELLER FROM UNSCREWING OFF OF SHAFT

This invention relates to a centrifugal pump including a system for preventing the fluid pumping impeller from unscrewing off of the pump shaft when the pump motor is operated in the wrong direction. More particularly, this invention relates to a centrifugal pump wherein the system for preventing impeller unscrewing includes first and second threaded attachments, these two threaded attachments having different thread pitches and different thread diameters so as to prevent the impeller from unscrewing during erroneous motor operation.

BACKGROUND OF THE INVENTION

Environmentally hazardous fluids, such as acids, oils, toxins, and the like often need to be pumped through fluid flow systems from one location to another. Centrifugal pumps including pump motors, pump shafts, and fluid pumping impellers are old and well-known for carrying out such tasks. For example, see commonly owned U.S. Pat. No. 5,261,676, the disclosure of which is hereby incorporated herein by reference.

The centrifugal pump of U.S. Pat. No. 5,261,676 includes a pump motor for driving a fluid pumping impeller, and an elongated pump shaft disposed between and connected to the motor and impeller for permitting the impeller to be driven. The impeller of the centrifugal pump of the '676 patent is connected to the end of the pump shaft by way of a threaded connection. This threaded connection is made up of male threads located around the outer periphery of the shaft end and corresponding female threads defined within a bore or hollowed out portion in the central body of the impeller. Thus, the impeller is simply screwed onto and over the pump shaft. When the pump motor is operated in the correct direction, it drives the impeller so as to pump fluid in a known manner.

However, when the pump motor is erroneously operated in the wrong direction, the impeller will tend to unscrew off of the pump shaft thereby severely damaging and possibly ruining the pump. Because of the nature of typical three-phase pump motors used in the industry, this has been found to be a significant problem.

Prior art FIG. 1 is a side cross-sectional view of a prior art centrifugal chemical processing pump 1. Pump 1 includes motor 3, pump shaft 5, and fluid pumping impeller 7. As illustrated, impeller 7 is connected to motor 3 by way of shaft 5 thereby enabling the motor to rotate/drive impeller 7 so as to pump fluid from inlet 9 toward and through pump outlet 11. Impeller 7 of pump 1 is located in pumping chamber 13. Pump 1 further includes casing 15 defining fluid pumping chamber 13, annular stationary member 17, inboard shaft supporting ball bearings 19, oil misting chamber 21 for lubricating the bearings, outboard shaft supporting ball bearings 23, annular seal gland 25, pump frame or housing 27, outboard bearing lock nut 29, pump shaft key coupling 31 for enabling connection to motor 3, seal 33, seal 35, seal 37, annular outboard bearing cover 39, mounting member 41, and adapter 43.

Unfortunately, impeller 7 of prior art pump 1 is also connected to pump shaft 5 by way of threads 45. Threads 45 include male threads disposed around the exterior of shaft 5 and female threads positioned within a bore defined in main body 47 of impeller 7. Unfortunately, as discussed above relative to the '676 patent, when pump motor 3 is operated or turned on so as to drive shaft 5 and impeller 7 in the wrong direction, this may cause impeller 7 to unscrew off of shaft 5 and bang around within chamber 13 thereby substantially damaging pump 1. This is undesirable.

The problem of operators turning on motor 3 in the wrong direction has been found to be significant in the industry. Typical pump motors 3 are of the three-phase type which translates into the fact that when a pump is installed and the motor initially turned on, the operator is often unsure which direction the motor 3 will turn shaft 5 (i.e. clockwise or counterclockwise). Thus, operators in the industry often quickly turn on the motor 3 (e.g. for a split second) so as to find out which direction the motor will rotate shaft 5 and impeller 7. Unfortunately, this often results in impeller 7 unscrewing off of shaft 5 when (i) motor 3 is not turned off quick enough; or (ii) impeller 7 immediately begins to unscrew due to the reverse rotation direction of shaft 5. This problem can be overcome by operators, when installing centrifugal pumps, decoupling the motor from the shaft, and then initially turning on the pump motor to find out which direction it will rotate the shaft to be attached thereto. Unfortunately, operators in the field tend not to undertake this time consuming process when installing pumps under many circumstances.

It is also worth noting that some impellers are attached to pump shafts via keyways. These are unrelated to this invention because there is no problem of unscrewing in such devices.

It is apparent from the above that there exists a need in the art for a centrifugal pump having a system built thereinto for the purpose of preventing the fluid pumping impeller from unscrewing off of the pump shaft if and/or when the pump motor is started or operated in the wrong direction. For example, let us assume that a particular pump is designed so that its motor is adapted to rotate the shaft and impeller in the clockwise direction so as to effect the pumping of fluid. There exists a need in the art for a pump including a system which will prevent the impeller from unscrewing off of the shaft when the motor of such a pump is initially turned on in the counterclockwise (i.e. wrong) direction.

It is a purpose of this invention to fulfill the above-described needs in the art, as well as other needs which will become apparent to the skilled artisan from the following detailed description of this invention.

SUMMARY OF THE INVENTION

Generally speaking, this invention fulfills the above-described needs in the art by providing a centrifugal pump having a motor, rotatable shaft driven by the motor, and an impeller affixed to a first end of the shaft via a first thread connection, the centrifugal pump comprising:

the motor for driving the shaft and the impeller in a first rotating direction so as to pump a fluid to be pumped;

threaded connection means operatively associated with the shaft and impeller for preventing the impeller from unscrewing if the motor is started so as to rotate the shaft in a second direction, the threaded connection means including the first thread connection and a second thread connection, the first and second thread connections having different diameters and different thread pitches thereby preventing the impeller from unscrewing off of the shaft when the motor is operated so as to drive the shaft in the second direction.

According to certain embodiments, both thread connection are right-handed, or alternatively, both are left-handed.

This invention still further fulfills the above-described needs in the art by providing a method of making a centrifugal pump in order to prevent a fluid pumping impeller from unscrewing off of a pump shaft if a pump motor is operated in a wrong direction, the method comprising the steps of:

providing a centrifugal pump including the motor and a pump housing;

inserting the pump shaft into the pump housing;

connecting the impeller to the pump shaft by screwing the impeller onto the shaft so as to define a first thread connection having a first diameter and a first thread pitch;

inserting a lock bolt through the impeller and screwing the lock bolt into the pump shaft so as to form a second thread connection having a second diameter and a second thread pitch; and forming the second thread connection so that the second thread connection has a higher thread pitch then the first thread connection thereby preventing the impeller from unscrewing off of the shaft if the motor is operated in the wrong direction.

This invention still further fulfills the above-described needs in the art by providing a pump comprising:

a rotatable pump shaft;

a fluid pumping impeller threadedly affixed to an end of the pump shaft via threads having a first thread pitch and a first diameter;

the pump shaft adapted to rotate in a first rotating direction in order to drive the impeller and pump a fluid to be pumped;

a bolt having a head and an elongated body, the bolt being threadedly affixed to the pump shaft via threads having a second thread pitch and a second diameter, the impeller being positioned between the head and the second threads; and wherein the second thread pitch is higher than the first thread pitch.

This invention will now be described with respect to certain embodiments thereof, accompanied by certain illustrations, wherein:

IN THE DRAWINGS

DETAILED DESCRIPTION OF CERTAIN EMBODIMENTS OF THIS INVENTION

Figure 1:
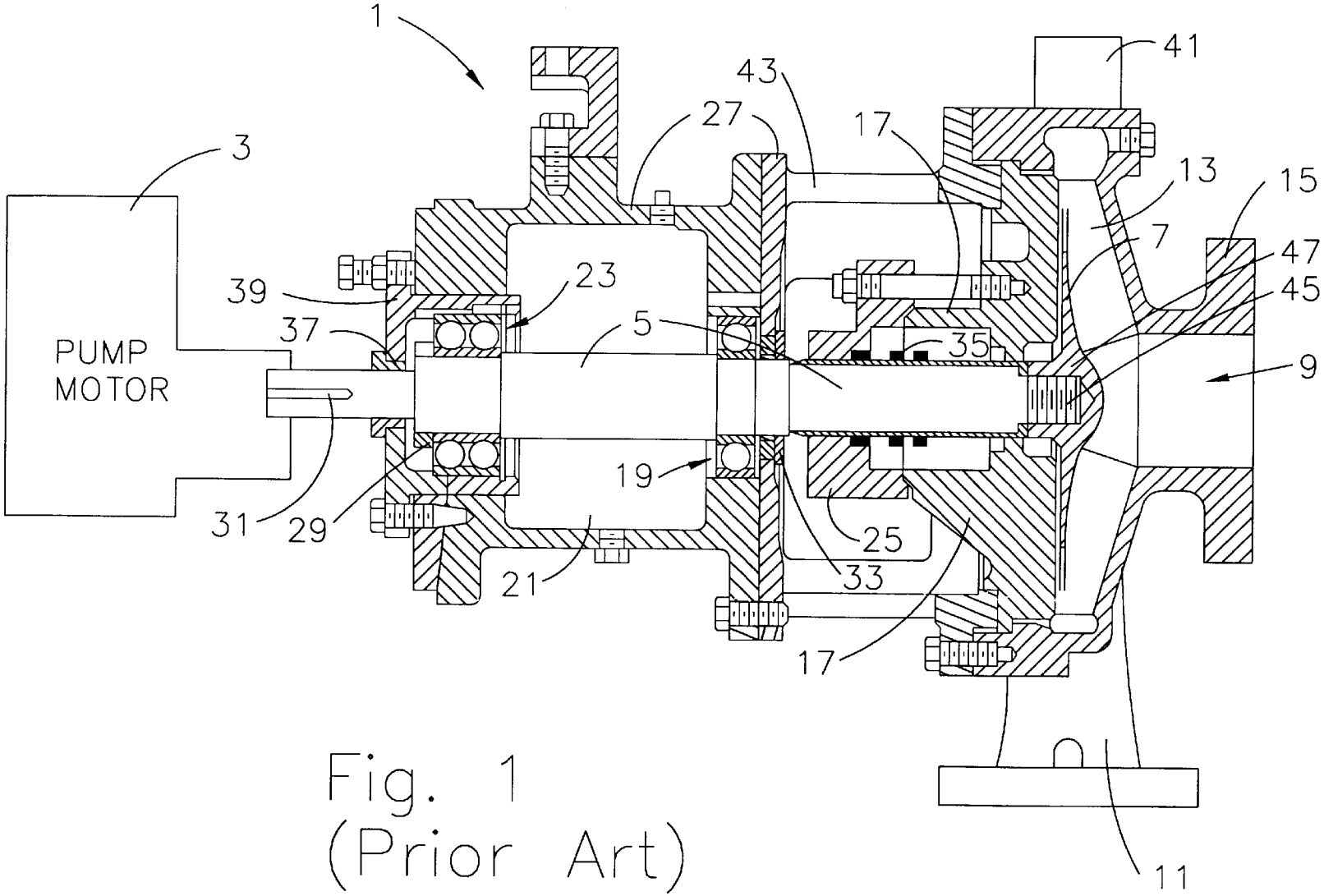
Fig. 1 (Prior Art)
FIG. 1 is a side cross-sectional view of a prior art centrifugal pump wherein the fluid pumping impeller is simply screwed onto the shaft which is adapted to be driven by the pump motor.

Referring now more particularly to the accompanying drawings in which like reference numerals indicate like parts throughout the several views.

Figure 2:
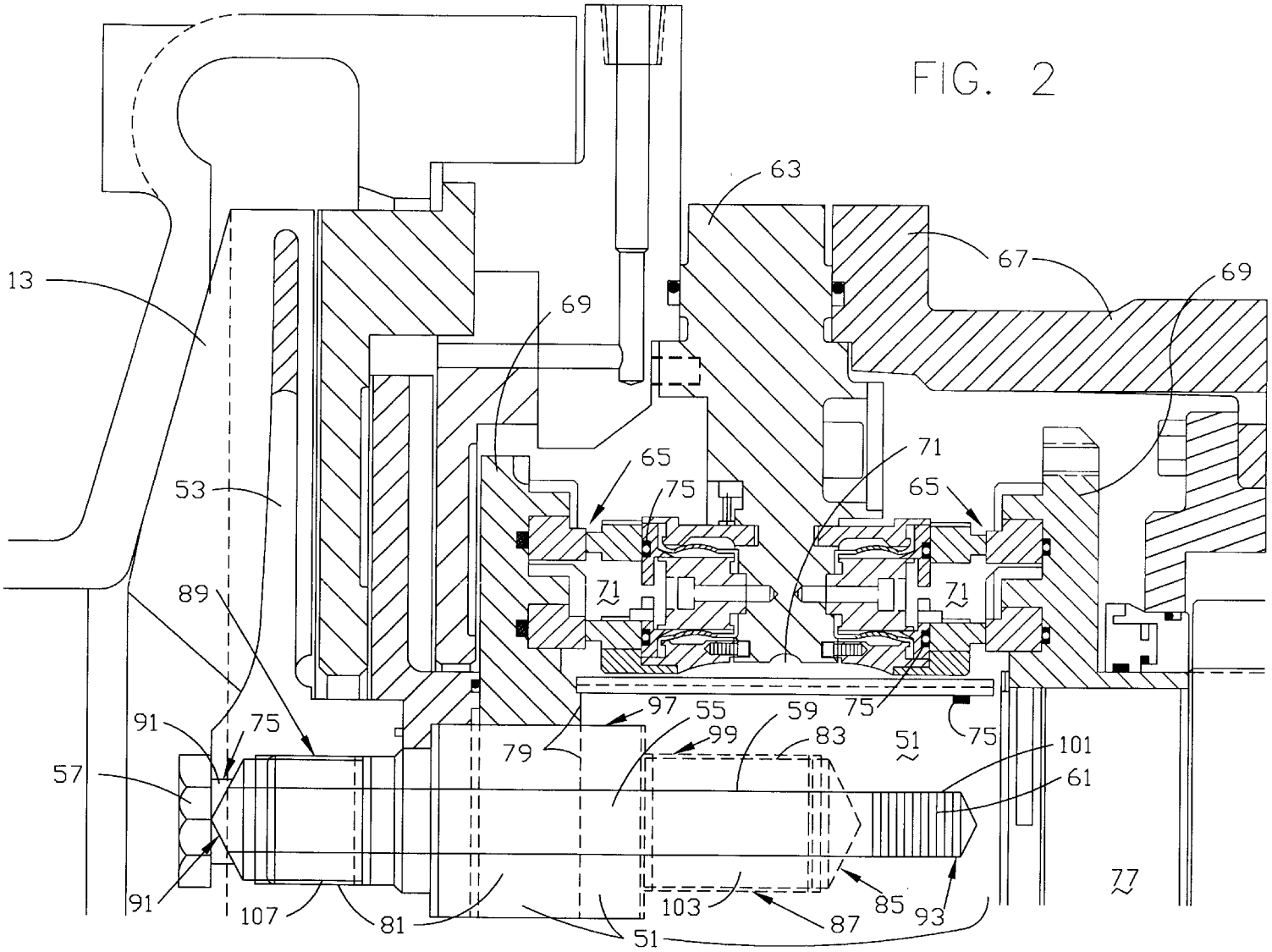
FIG. 2 is a side cross-sectional view of the upper half of a centrifugal pump according to an embodiment of this invention, the pump including a system for preventing the fluid pumping impeller from unscrewing off of the pump shaft when the pump motor is rotated in the wrong direction.

FIG. 2 is a side cross-sectional view of the upper half of a centrifugal pump according to an embodiment of this invention, the pump including a mechanical system for preventing the fluid pumping impeller from unscrewing off of the pump shaft when the shaft is rotated in the wrong direction by the pump motor. The remainder of the pump may be as in FIG. 1.

Referring to FIG. 2, the centrifugal chemical processing pump includes pump shaft 51, adapted to be driven by the pump motor, fluid pumping impeller 53 attached to the end of shaft 51, fluid pumping chamber 13 housing impeller 53, lock bolt 55 including bolt head 57 and bolt elongated body 59 having male or external threads 61 thereon, stationary gland 63 for supporting fluid seals 65, pump housing 67, rotating seal flanges 69 which rotate along with and/or connected to shaft 51, annular barrier chambers 71 disposed between the seals, chambers 71 adapted to house barrier fluid(s) which is caused to circulate to and from chambers 71 in order to maintain seals 65 clean and in a temperature stabilized state, and O-rings 75.

The system for preventing impeller 53 from unscrewing off of rotatable pump shaft 51 will now be described in detail. Pump shaft 51 includes at least two elongated members, namely main shaft 77 having one end connected to the pump motor and the other end 79 ending approximately below the leftward most seals 65; and shaft stub 81 attached thereto. Shaft stub 81 is screwed into a bore in the end of main shaft 77 by way of threads 83. Thus, bore 85 is provided within ma in shaft 77 for the purpose of receiving the threads 83 of shaft stub 81. The internal diameter of bore 85 includes female threads 83 for receiving the corresponding male threads provided around the exterior periphery of shaft stub 81 at 87. Thus, shaft stub 81 is non-rotatably connected or affixed to main shaft 77 thereby making up pump shaft 51.

Impeller 53 is attached to the other end of shaft stub 81 by way of threads 89. The thread connection at 89 of impeller 53 to shaft 51 includes male threads arranged around the exterior of stub 81 and corresponding female threads located within the bore or hole hollowed out within impeller 53. Thus, thread connection 89 is made up of male shaft threads and female impeller threads. Thread connection 89 may have, for example, a three-quarter inch diameter and a thread pitch of 10 according to certain embodiments of this invention.

After impeller 53 has been screwed onto stub 81 of pump shaft 51, elongated lock bolt 55 is inserted through a hole or opening 91 in the impeller and through a corresponding elongated hole or hollowed out portion in stub 81 and main shaft 77 so that the distal end of bolt 55 is threadedly connected to main shaft 77 by way of threads 61 in female threaded bore 93. The threaded connection at 61, 93 may have, for example, a one-half inch thread diameter and a thread pitch of 13 according to certain embodiments of this invention. Thus, thread connection 61 between lock bolt 55 and main shaft 77 includes male bolt threads and female shaft threads which work in conjunction with one another in a known manner. Threaded connections 89 and 61, according to certain embodiments of this invention, are either both right-handed threaded connections, or alternatively are both left-handed threaded connections.

As illustrated in FIG. 2, main shaft 77 of pump shaft 51 includes three diameter different holes or bores drilled therein. Starting from the bore with the largest diameter, main shaft 77 has defined therein, bore 97, bore 99, and finally bore 101. Bore 97 in main shaft 77 is adapted to receive the largest diameter portion of shaft stub 81. There are no threads defined in the periphery of bore 97. Bore 99 on the other hand is adapted to threadedly receive portion 103 of shaft stub 81. The threads along the exterior of portion 103 work in conjunction with the shaft threads of bore 99 to make up thread connection 83. Bore 101 in main shaft 77 is adapted to threadedly receive the threaded portion 61 of elongated bolt 55, while the remainder of the elongated body 59 of bolt 55 extends through bores 97, 99, and an aperture defined in the stub 81. Meanwhile, fluid pumping impeller 53 includes bore 107 defined in the main body thereof. Bore 107 in impeller 53 is adapted to threadedly receive the threaded end of shaft stub 81 via threads 89. When bolt 55 is inserted through impeller 53, shaft stub 81 and main shaft 77 during manufacture of the pump, the bolt is positioned so that after installation the head 57 of bolt 55 directly contacts the outer face of impeller 53 as illustrated in FIG. 2.

It will now be described how the anti-unscrewing system described above prevents impeller 53 from unscrewing off of shaft 51 when the pump motor is operated or turned on in the wrong direction. For example, let us assume that the driving system of the FIG. 2 pump is designed so that the pump motor is adapted to rotate pump shaft 51 and impeller 53 in the clockwise direction in order to pump the fluid to be pumped from chamber 13 in a known manner. When the pump motor is turned on so as to rotate shaft 51 and impeller 53 in this clockwise direction, the pump works perfectly fine (the threaded connections 89 and 61 are tightened) and functions to pump the fluid to be pumped. However, the problem in the prior art exists when the pump motor was turned on the in wrong direction (i.e. in the counterclockwise direction according to this example). According to the FIG. 2 embodiment of this invention, when the pump motor is turned on so as to rotate pump shaft 51 in the counterclockwise direction (i.e. the wrong direction), the system described above prevents impeller 53 from unscrewing. When shaft 51 rotates in a counterclockwise direction, the following two things occur: (i) impeller 53 wants to unscrew off of the pump shaft via threads 89; and (ii) bolt 55 wants to unscrew out of main shaft 77 by way of threads 61. However, because the thread pitch of thread connections 61 and 89 are different as described above (i.e. the thread pitch of threads 61 is higher or greater than the pitch of threads 89), impeller 53 wants to move axially off of the pump shaft (i.e. to the left) at a faster rate than does bolt 55. Because impeller 53 and bolt 55 wants to unscrew at different axial rates (i.e. impeller 53 wants to move axially leftward at a faster rate than bolt 55), they lock up on one another due to bolt head 57, thereby preventing both the impeller and the bolt from unscrewing. Accordingly, the problem discussed above relative to the prior art has been solved in an efficient and easy to manufacture manner.

Once given the above disclosure, therefore, various other modifications, features, and/or improvement will become apparent to the skilled artisan. Such other features, modifications, and improvements are thus considered a part of this invention, the scope of which is to be determined by the following claims.

I claim:

1. A centrifugal pump having a motor, a rotatable shaft driven by the motor, and an impeller affixed to a first end of the shaft via a first thread connection, the centrifugal pump comprising:

said motor for driving or rotating said shaft and said impeller in a first rotating direction so as to pump a fluid to be pumped;

threaded connection means operatively associated with said shaft and impeller for preventing said impeller from unscrewing if said motor is started so as to rotate said shaft in a second direction, said threaded connection means including said first thread connection and a second thread connection, said first and second thread connections having different diameters and different thread pitches thereby preventing said impeller from unscrewing off of said shaft when said motor is operated so as to drive said shaft in the second direction.

2. The centrifugal pump of claim 1, wherein said threaded connection means includes an elongated lock bolt including a head and an elongated body which forms part of said second thread connection.

3. The centrifugal pump of claim 2, wherein said bolt is arranged so that said head is located adjacent said impeller so as to prevent said impeller from unscrewing, and said elongated body is fed through said impeller and said pump shaft so that said elongated body of said bolt is connected to said pump shaft via said second thread connection.

4. The centrifugal pump of claim 3, wherein said elongated body is fed through a centrally located hole or aperture in said impeller, and said elongated body is not directly threadedly connected to said impeller.

5. The centrifugal pump of claim 4, wherein said first thread connection includes shaft threads on the outer diameter of said pump shaft and corresponding threads located on the surface of an inner bore defined in the body of said impeller.

6. The centrifugal pump of claim 5, wherein said pump shaft includes a main shaft and a shaft stub connected to an end of said main shaft, said stub and said main shaft being connected by way of a third thread connection, and wherein said shaft threads of said first thread connection are located around the outer periphery of said stub.

7. The centrifugal pump of claim 6, wherein said third thread connection is axially located along the pump shaft between said first and second thread connections.

8. The centrifugal pump of claim 7, wherein the diameter of said second thread connection is less than the diameter of said first thread connection, and the pitch of said thread pitch of said first thread connection is less than the thread pitch of said second thread connection.

9. The centrifugal pump of claim 1, wherein the thread pitch of said second thread connection is higher than the thread pitch of said first thread connection so that said second thread connection has move threads per inch than said first thread connection.

10. A method of making a centrifugal pump in order to prevent a fluid pumping impeller from unscrewing off of a pump shaft if a pump motor is operated in a wrong direction, the method comprising the steps of:

providing a centrifugal pump including said motor and a pump housing;

inserting said pump shaft into said pump housing;

connecting said impeller to said pump shaft by screwing said impeller onto said shaft so as to define a first thread connection having a first diameter and a first thread pitch;

inserting a lock bolt through said impeller and screwing said lock bolt into said pump shaft so as to form a second thread connection having a second diameter and a second thread pitch; and forming said second thread connection so that said second thread connection has a higher thread pitch than said first thread connection thereby preventing said impeller from unscrewing off of said shaft if said motor is operated in the wrong direction.

11. A pump comprising:

a rotatable pump shaft;

a fluid pumping impeller threadedly affixed to an end of said pump shaft via threads having a first thread pitch and a first diameter;

said pump shaft adapted to rotate in a first rotating direction in order to drive said impeller and pump a fluid to be pumped;

a bolt having a head and an elongated body, said bolt being threadedly affixed to said pump shaft via threads having a second thread pitch and a second diameter, said impeller being positioned between said head and said second threads; and wherein said second thread pitch is higher than said first thread pitch.

12. The pump of claim 11, wherein said pump shaft includes a main shaft and a shaft stub affixed thereto, and wherein said second threads are within said main shaft and said first threads are located around the periphery of said shaft stub.

13. The pump of claim 11, wherein said first diameter is greater than said second diameter.

14. The pump of claim 13, wherein said head of said bolt contacts an outer face of said impeller.

15. The pump of claim 11, wherein said impeller is one of an open type and a closed type impeller.

* * * * *